US005732649A

United States Patent [19]

Falcone

[11] Patent Number: 5,732,649

[45] Date of Patent: Mar. 31, 1998

[54] FLOATING DOCK SYSTEM

[76] Inventor: Paul P. Falcone, 2808 11th St., N., St. Petersburg, Fla. 33734

[21] Appl. No.: 717,818

[22] Filed: Sep. 24, 1996

[51] Int. Cl.[6] ..... B63B 35/44

[52] U.S. Cl. ..... 114/263

[58] Field of Search ..... 114/263, 266, 114/267, 264, 77 R, 77 A, 88, 352; 405/218, 219

[56] References Cited

U.S. PATENT DOCUMENTS 4,418,634 12/1983 Gerbus ..... 114/263
4,559,891 12/1985 Shorter, Jr. .
4,928,617 5/1990 Meriwether .
4,940,021 7/1990 Rytand .

*Primary Examiner*—Stephen Avila

[57] ABSTRACT

A floating dock system includes individual modules that may be interconnected together by interposing whalers to adjoining faces of adjacent modules. Each module includes a one-piece molded plastic portion having a top surface deck and pre-formed chaseways sized to receive structural rods as well as optional orthogonal open areas designed to allow installation of utilities. A plastic tub containing a flotation pontoon is mounted to the underside of each molded plastic portion.

12 Claims, 6 Drawing Sheets

FLOATING DOCK SYSTEM

BACKGROUND OF THE INVENTION

The present invention relates to a floating dock system. In the prior art, floating dock systems are generally known. However, Applicant is unaware of any such system including all of the features and aspects of the present invention. The following prior art is known to Applicant:

U.S. Pat. No. 4,559,891 to Shorter, Jr. discloses a floatable pontoon that has an open container filled with a moldable cap made of a concrete-like material. A float is mounted to the underside of the container and at least one stringer holds adjacent pontoons together with rods extending through the concrete-like material. The present invention differs from the teachings of Shorter, Jr. as contemplating a floating dock system including a molded plastic portion having chaseways to receive structural rods as well as orthogonal open areas allowing installation of utilities.

U.S. Pat. No. 4,928,617 to Meriwether discloses a modular float drum system wherein the drums are made from polyethylene and are constructed in modules in various configurations. Each drum module has a top wall, a bottom wall and a contiguous first, second, third and fourth wall extending between the top and bottom walls to define a buoyant enclosure. A securing device is formed on one of the sides of each module for releasably joining one module to another in an aligned relationship. The present invention differs from the teachings of Meriwether as contemplating a floating dock system having a molded plastic portion with chaseways sized to receive structural rods and orthogonal openings designed to permit installation of utilities.

U.S. Pat. No. 4,940,021 to Rytand discloses a floating dock including a plurality of aligned float modules each having opposing walls and an overlapping dock mounted above each flat module with each float module comprising concrete cup-like containers containing buoyant material such as foam plastic. Rytand also discloses the use of compression rods to exert compressive forces on both the container and the decking. Openings are provided to allow installation of utilities. The present invention differs from the teachings of Rytand since the present invention provides chaseways for receipt of the structural rods which partially enclose them to limit exposure to the elements. Furthermore, in the present invention, the upper portion is made in a single piece of molded plastic.

SUMMARY OF THE INVENTION

The present invention relates to a floating dock system. The present invention includes the following interrelated objects, aspects and features:

(1) In a first aspect, the heart of the present invention consists of a monolithic molded plastic portion wherein the mold that is employed is provided with structure causing the molded plastic portion to be formed as a rectangular cubic structure of desired length, width and thickness and including chaseways designed to partially enclose and receive structural rods that have threaded ends to allow application of compression to the molded plastic portion. The molded plastic portion further may include open areas orthogonal to the chaseways that provide for the installation of utilities such as water, electric power, telephone and cable through the floating dock system. Decking is a molded integral part of the monolithic molded plastic portion.

(2) A flotation pontoon is mounted to the underside of the molded plastic portion through the use of a plastic tub having a periphery suitably fastened to the underside of the molded plastic portion.

(3) Opposed side edges of the molded plastic portion are provided with double whalers that are interconnected together through use of the structural rods. In particular, each whaler has a plurality of spaced holes therethrough designed to receive ends of the structural rods. Threaded nuts threadably received on the threaded ends of the structural rods allow tightening of the whalers on the sides of the molded plastic portion and compression thereof. The components described in paragraphs 1–3 comprise a module.

(5) The whalers may be used to allow attachment of interior surfaces of adjacent modules together. In particular, whalers are placed on the sides of the molded plastic portion and are used to either laminate together adjacent modules or, alternatively, structural rods are provided that are long enough to extend through adjacent modules whereupon tightening of threaded nuts at the extremities of two adjacent modules allows fastening of them together.

Accordingly, it is a first object of the present invention to provide a floating dock system.

It is a further object of the present invention to provide such a system including a molded plastic portion to which whalers and a flotation pontoon may be suitably fastened to form a module.

It is a yet further object of the present invention to provide such a molded plastic portion with chaseways to receive structural rods as well as optional orthogonal openings designed to receive utilities.

It is a yet further object of the present invention to provide such a system wherein a plurality of dock modules may be interconnected together to form a dock system.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
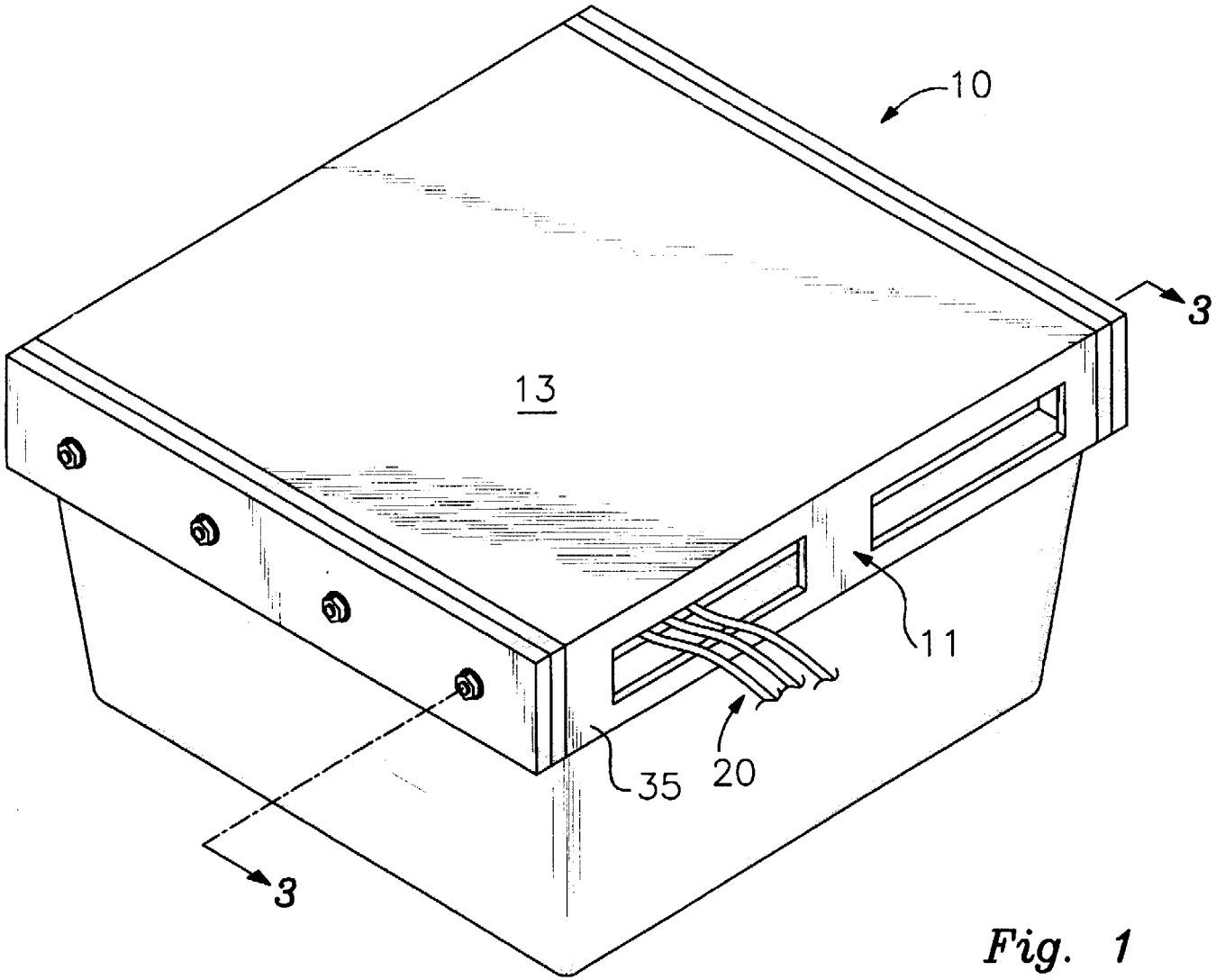
FIG. 1 shows a front/side perspective view of a single dock module of the inventive system.
Figure 2:
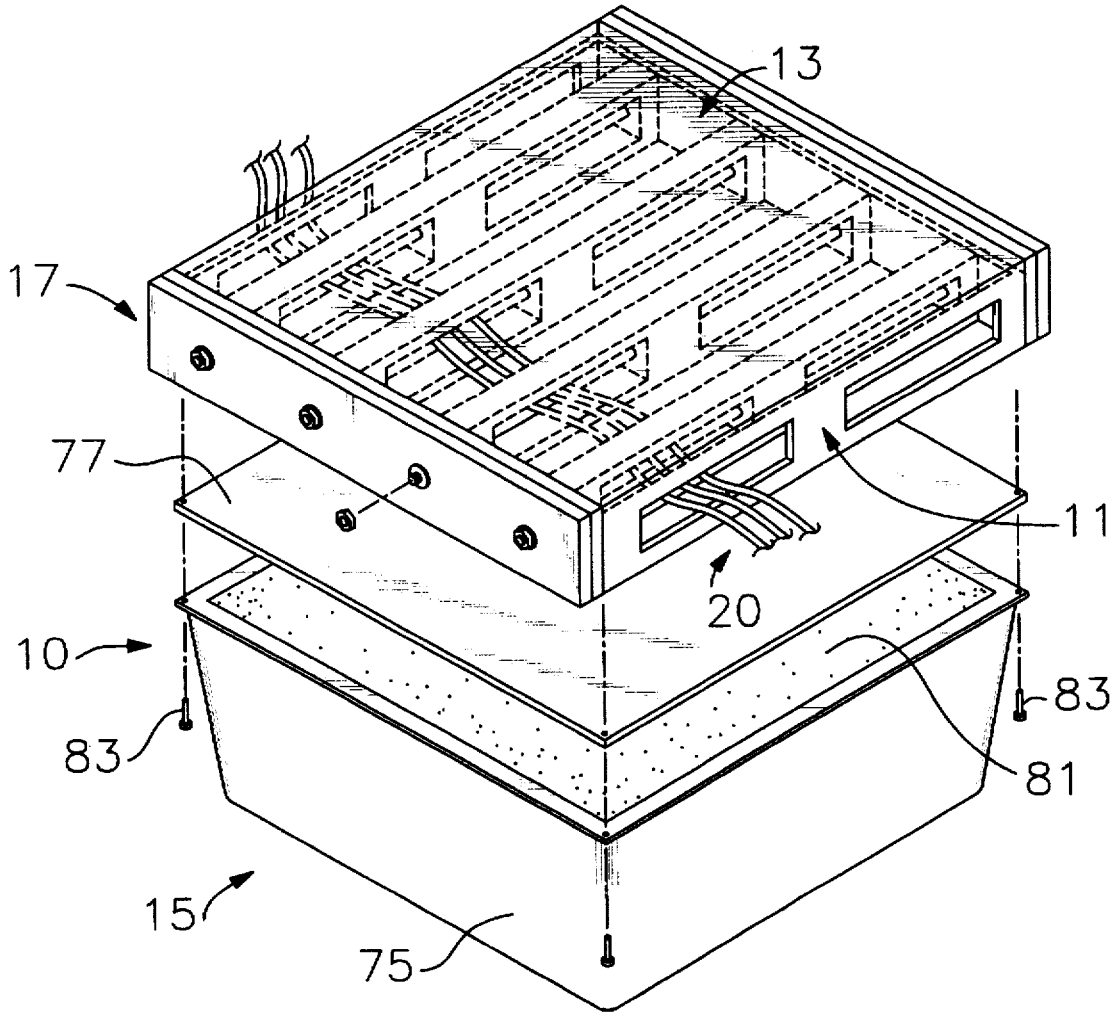
FIG. 2 shows an exploded perspective view from the same perspective as that of FIG. 1.

With reference, first, to FIGS. 1 and 2, a module in accordance with the teachings of the present invention is generally designated by the reference numeral 10 and is seen to include a monolithic molded plastic portion 11 including decking 13 as a top integral portion of the molded plastic portion 11, a plastic flotation portion such as a pontoon generally designated by the reference numeral 15 and double whalers generally designated by the reference numeral 17 and affixed to the sides of the molded plastic portion 11.

Figure 3:
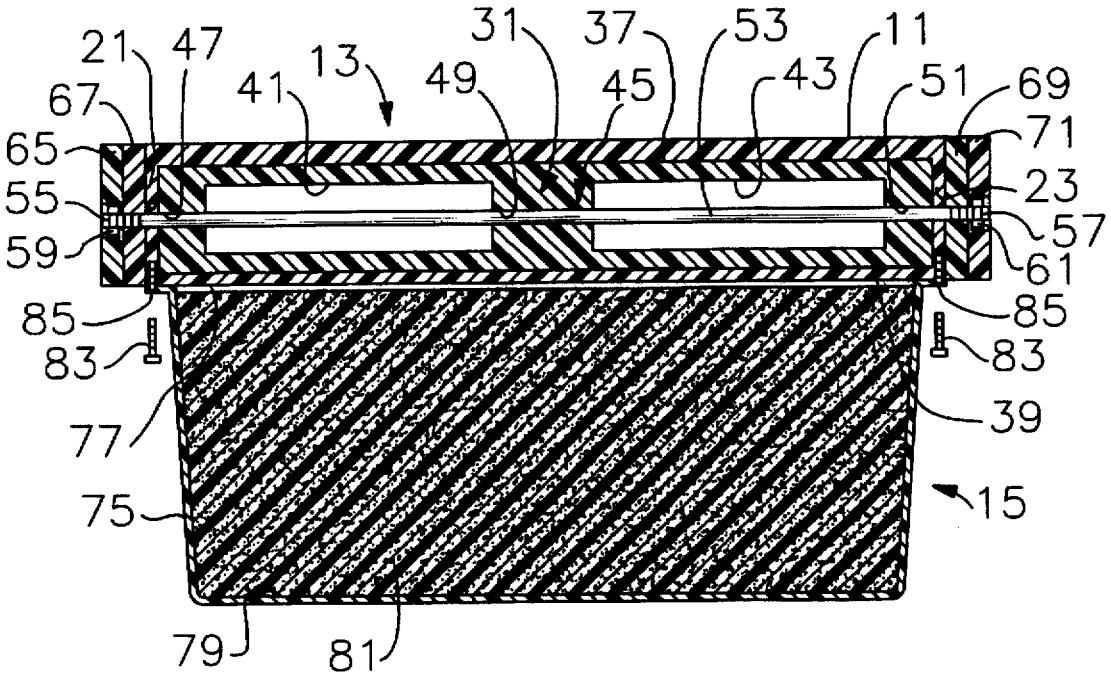
FIG. 3 shows a cross-sectional view along the line 3—3 of FIG. 1.

With reference to FIGS. 1–6, the monolothic molded plastic portion 11 includes integral side walls 21 and 23 that support, therebetween, a plurality of integral spaced structural portions 25, 27, 29 and 31. In addition, elongated members 33 and 35 (FIG. 6) integrally interconnect the ends of the side walls 21 and 23 together to form a strong one piece structural unit. FIG. 3 shows particular details of the structural portion 31 that are typical of all of the structural portions. As seen in FIG. 3, the structural portion 31 includes a top wall 37, a bottom wall 39 and two spaced rectangular openings 41 and 43 with a solid portion 45 between the openings 41 and 43. Orthogonal to the openings 41 and 43 are aligned holes 47, 49 and 51 that receive a structural rod 53 having ends 55 and 57 that are threaded to receive threaded nuts 59 and 61, respectively. The holes 47, 49 and 51 enclose the rod 53 at those locations to protect it and prevent it from buckling under stress. The openings 41 and 43 are optionally provided in alignment with corresponding holes in the other structural portions 25, 27 and 29, to allow utilities such as water pipes, electrical conduits, telephone wires and cable wires to be extended through the monolothic molded plastic portion 11. These utilities are generally shown in FIGS. 1 and 2 and designated by the reference numeral 20.

Figure 5:
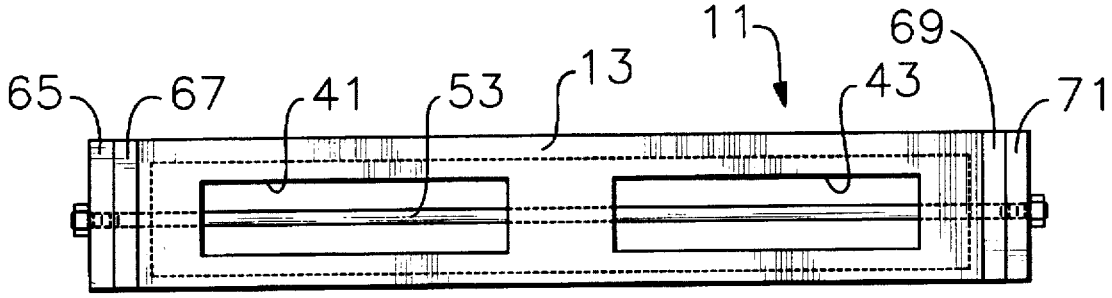
FIG. 5 shows a front view of the monolithic molded plastic portion of the module shown in FIGS. 1–4.
Figure 6:
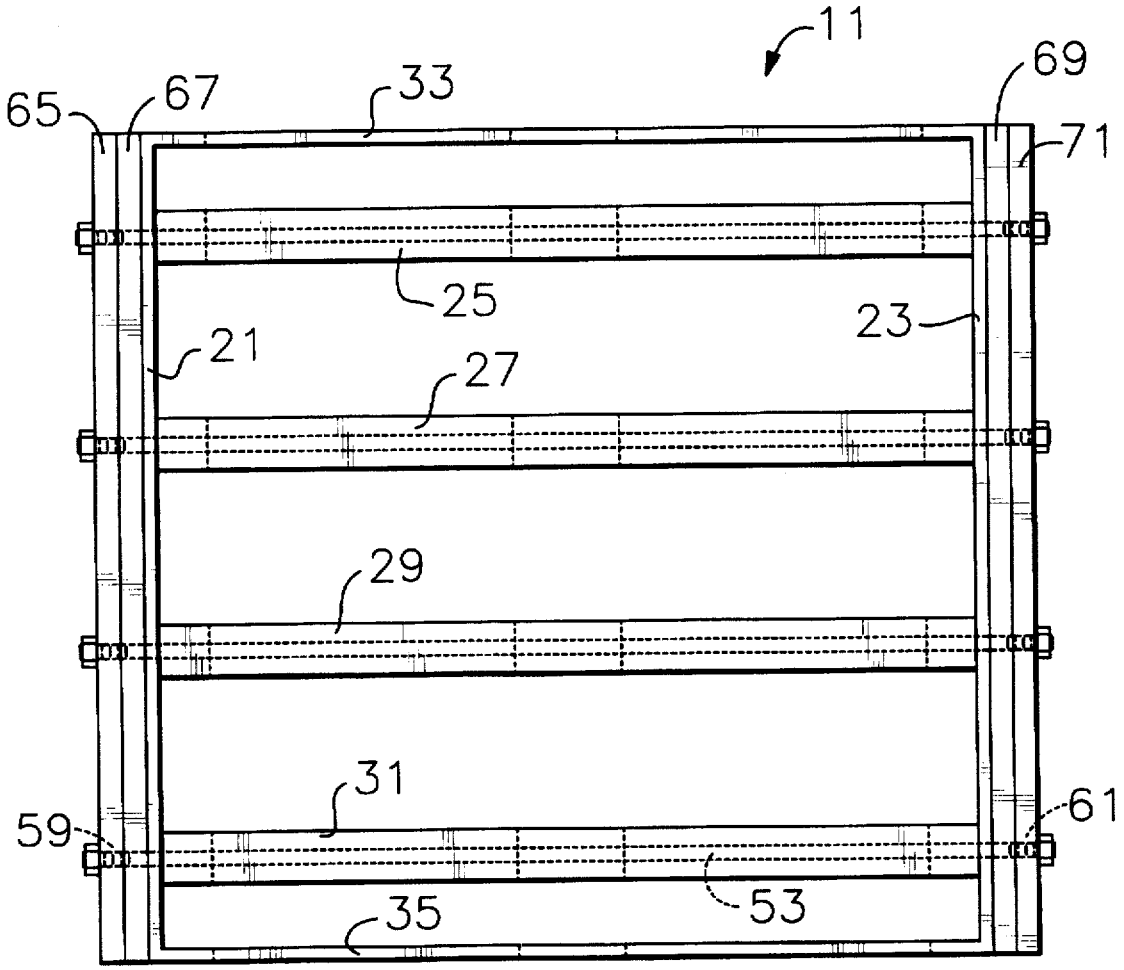
FIG. 6 shows a top view of the molded plastic portion shown in FIG. 5.

As seen, in particular, in FIGS. 3, 5 and 6, double whalers 65, 67, 69 and 71 are fastened to the sides of the monolithic molded plastic portion 11 with the whalers 65 and 67 fastened on one side thereof and with the whalers 69 and 71 fastened on the other side thereof. As seen in FIG. 3, holes are formed through the whalers in alignment with the holes 47, 49 and 51 through the molded plastic portion 11 so that the structural rod 53 may extend therethrough and may fasten the whalers to the sides of the molded plastic portion 11 through the use of the nuts 59 and 61.

Figure 4:
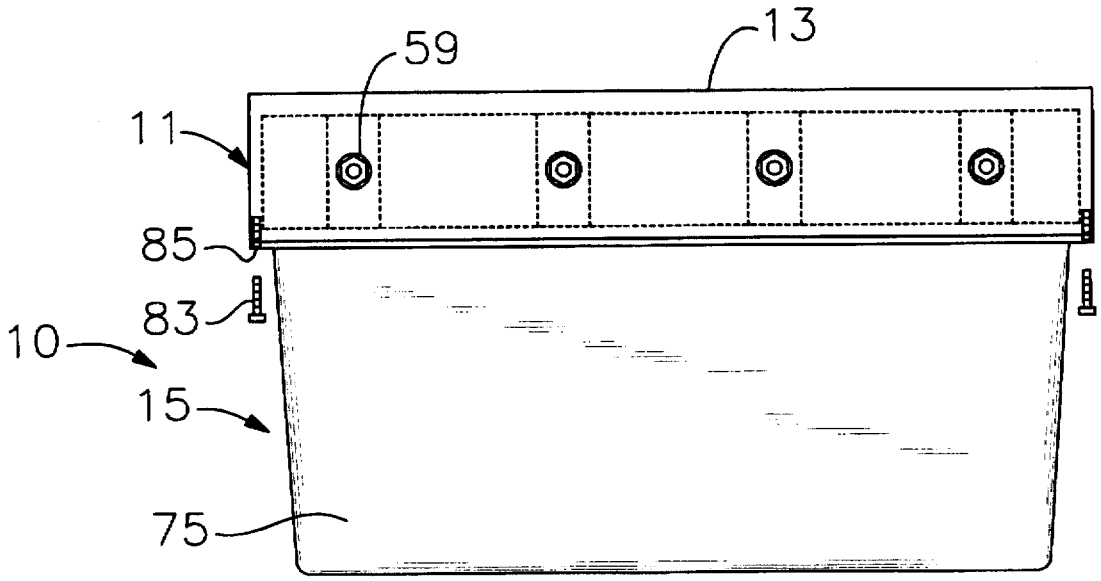
FIG. 4 shows a side view of the module illustrated in FIGS. 1–3.

As seen in FIGS. 2, 3 and 4, in particular, the flotation pontoon 15 includes a tub 75 having a lid 77, with the tub 75 defining a chamber 79 in which is received a buoyant foamed porous plastic float material 81. The float material 81 can be a polyurethane or polystyrene polymer. The pontoon 15 is suitably fastened to the underside of the monolithic molded plastic portion 11 through the use of screws 83 received in threaded openings 85 in the side walls 21, 23 of the molded plastic portion 11. In the preferred embodiment of the present invention, the tub 75 and lid 77 are made of a plastic such as polyethylene. Similarly, the molded plastic portion 11 is preferably made of molded polyethylene, as well.

Figure 7:
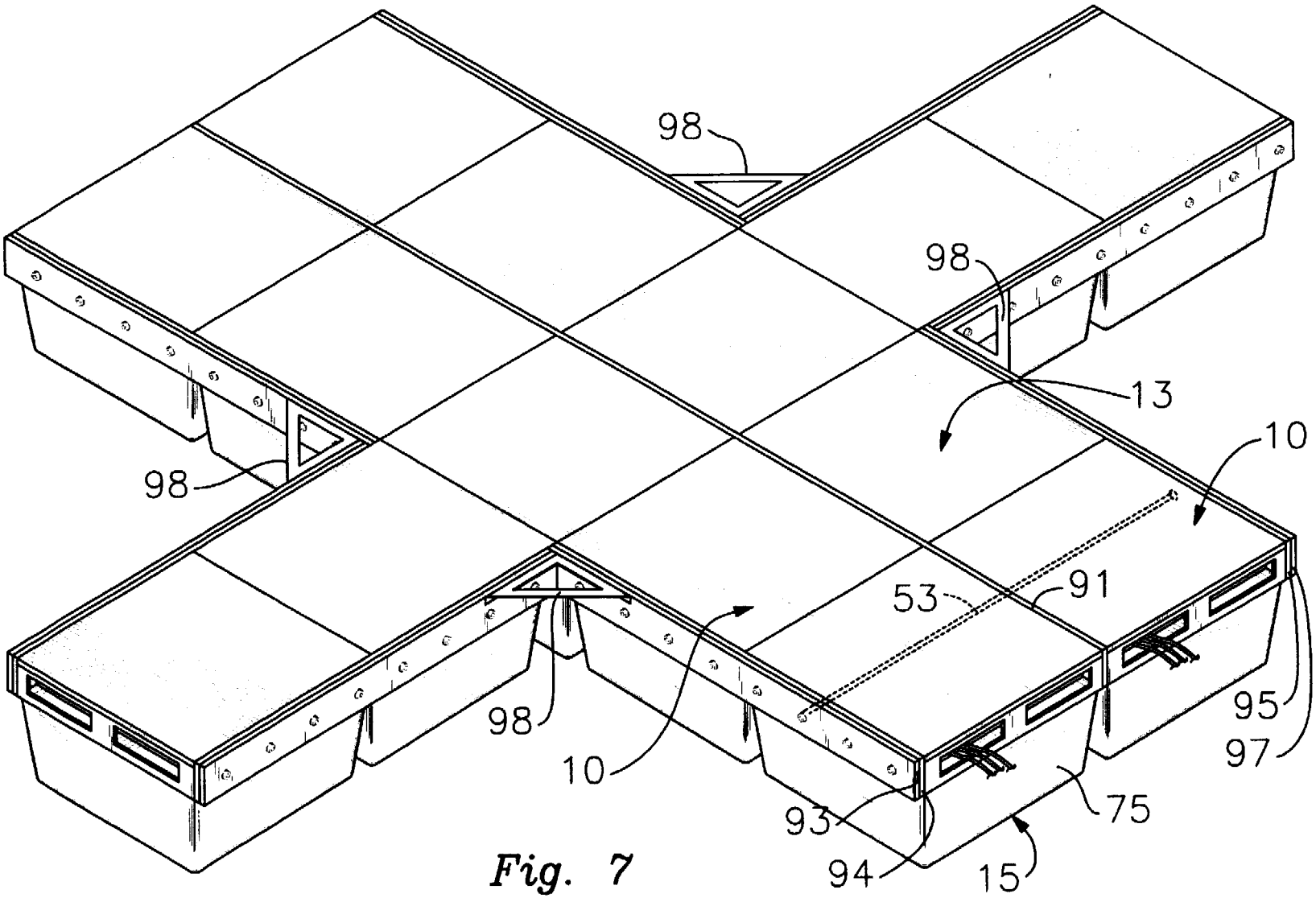
FIG. 7 shows a perspective view of a dock system including a plurality of modules suitably fastened together.
Figure 8:
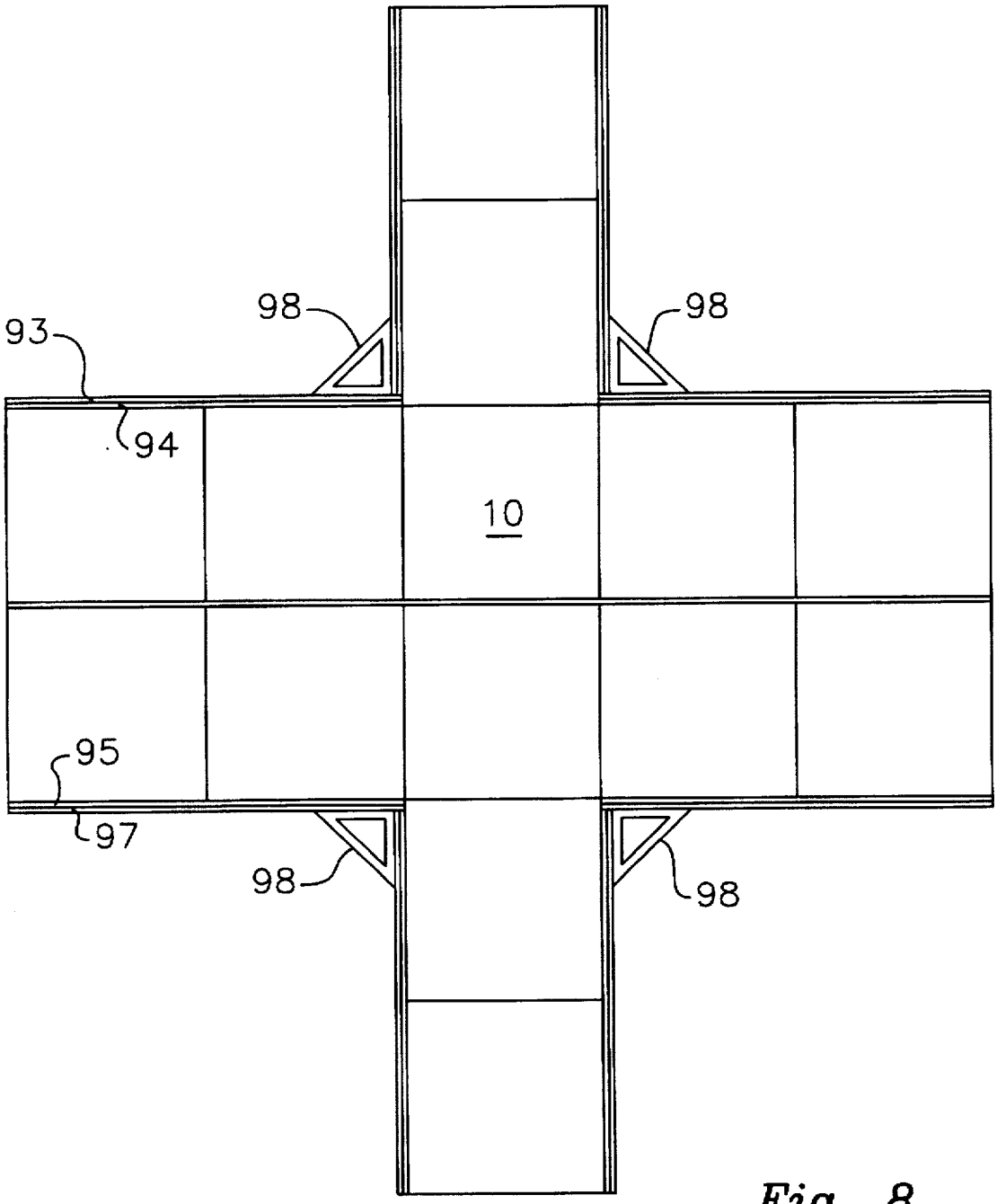
FIG. 8 shows a top view of the system shown in FIG. 7.

With reference to FIGS. 7 and 8, a multiplicity of modules such as the module 10 illustrated in FIGS. 1–6 may be suitably interconnected to form a dock system. As seen in FIGS. 7 and 8, a multiplicity of modules 10 are so interconnected. Of note in FIGS. 7 and 8 is the single whaler 91 extending between adjacent modules 10 and the double whalers 93, 94, 95 and 97 on opposed sides of adjacent modules 10. As shown in phantom in FIG. 7, structural rods 53 extend completely from the whaler 93 to the whaler 97 with each rod 53 having threaded ends such as the threaded ends 55, 57 illustrated in FIG. 3. Threaded nuts such as the nuts 59 and 61 shown in FIG. 3 are threaded on the opposed ends of the structural rod 53 to hold the whalers 93, 94, 91, 95, 97 and the modules 10, 10 together. Where portions of the dock system intersect at right angles, as seen in FIGS. 7 and 8, knee braces 98 are suitably fastened at the intersecting corners. In this way, a strong dock system may be created.

In accordance with the teachings of the present invention, by making the monolithic molded plastic portion through injection of plastic into a mold of a specific design, a comparatively larger volume of square foot decking surface per unit weight is produced as compared to the prior art. Maximum strength for a dock system is provided while maintaining weight at a minimum. In addition, by making the molded plastic portion of a single piece, hardware and the labor required to install it are both eliminated. When the structural rods 53 are tightened through use of the threaded nuts 59 and 61, the resultant compression provides rigidity through the box beam construction technique as is known.

Accordingly, an invention has been disclosed in terms of a preferred embodiment thereof which fulfills each and every one of the objects of the present invention as set forth hereinabove and provides a new and useful floating dock system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A floating dock module, comprising:

a) a one-piece molded plastic portion of a generally rectangular cubic shape and including a plurality of spaced elongated structural portions each of which includes a longitudinal hole therethrough and a deck formed by a top surface thereof;

b) a float mounted below said one-piece molded plastic portion; and c) an elongated whaler on each side of said one-piece molded plastic portion, said whalers being mounted to said one-piece molded plastic portion by a structural rod extending through each longitudinal hole of each elongated structural portion, each rod having threaded ends threadably receiving threaded nuts tightened to compress said whalers against said sides.

2. The module of claim 1, wherein there is at least one opening orthogonal to said longitudinal hole sized to receive utilities therethrough.

3. The module of claim 2 wherein said at least one opening orthogonal to said longitudinal hole comprises two spaced apart openings sized to receive utilities.

4. The module of claim 3, wherein said openings are rectangular.

5. The module of claim 1, wherein said float comprises a plastic tub containing foamed plastic.

6. The module of claim 1, including a plurality of whalers on each side of said one-piece molded plastic portion.

7. A floating dock system comprising a plurality of modules as claimed in claim 1, wherein a single whaler is interposed between adjacent modules, said structural rods extending completely through adjacent modules and being fastened to outboard whalers on outboard sides of said adjacent modules to fasten said adjacent modules together.

8. The floating dock system of claim 7, wherein said outboard whalers are elongated beyond a length of said adjacent modules whereby a plurality of additional adjacent modules may be consecutively fastened together.

9. A floating dock system comprising:

(a) a plurality of adjacent dock modules fastened together by an outboard and inboard elongated whaler with structural rods extending completely through adjacent dock modules and being fastened to outboard whalers on outboard sides of each adjacent dock module to fasten adjacent modules together;

(b) each dock module having a one-piece molded plastic portion, including a plurality of spaced elongated structural portions therein having a longitudinal hole therethrough to receive said structural rods and a top surface of the molded plastic portion forming a deck; and (c) a plastic float portion filled with a porous polymer attached to and mounted below the one-piece molded plastic portion.

10. The floating dock system according to claim 9 wherein the plastic float portion is filled with a polyurethane polymer.

11. The floating dock system according to claim 9 wherein each dock module has at least one opening orthogonal to said longitudinal hole for receipt of a utility line.

12. The floating dock system according to claim 11 wherein each dock module has two spaced rectangular openings side by side and orthogonal to said longitudinal hole to receive utilities therethrough.

* * * * *